United States Patent [19]

Bowditch

[11] Patent Number: 4,607,584

[45] Date of Patent: Aug. 26, 1986

[54] SYSTEM FOR FOLDING LIMP MATERIAL SEGMENTS

[75] Inventor: Philip N. Bowditch, Cohasset, Mass.

[73] Assignee: The Charles Stark Draper Laboratory, Inc., Cambridge, Mass.

[21] Appl. No.: 658,511

[22] Filed: Oct. 9, 1984

[51] Int. Cl.[4] ..... D05B 35/00; D05B 19/00

[52] U.S. Cl. ..... 112/147; 112/121.11; 112/304; 112/309

[58] Field of Search ..... 112/147, 141, 136, 121.11, 112/121.12, 121.15, 121.14, 304, 309

[56] References Cited

U.S. PATENT DOCUMENTS

| | | | |
|---|---|---|---|
| 3,477,397 | 11/1969 | Hawley | 112/304 X |
| 3,638,592 | 2/1972 | Fryatt | 112/121.14 |
| 4,401,044 | 8/1983 | Bowditch | 112/121.12 X |
| 4,457,243 | 7/1984 | Bowditch | 112/304 X |
| 4,463,697 | 8/1984 | Vogt et al. | 112/121.15 |
| 4,512,269 | 4/1985 | Bowditch | 112/121.12 |

*Primary Examiner*—H. Hampton Hunter
*Attorney, Agent, or Firm*—Lahive & Cockfield

[57] ABSTRACT

A system for folding limp material segments. A system includes a support surface for the segment, a belt assembly including a matrix of elongated parallel endless belts overlying that surface. A controller for permitting rotation of the surface with respect to the belt matrix, a fold-locus-defining assembly including a sheet member having a leading edge which may be adjustably positioned with respect to a material segment between the belts and the support surface, a sensor for generating a position signal representative of the segment on the support surface. A controller is responsive to the position signal and applied signals representative of a desired fold locus on the segment to control the belt assembly, the support surface, the fold-locus-defining assembly so that the segment is folded about a desired linear folding locus.

12 Claims, 13 Drawing Figures

SYSTEM FOR FOLDING LIMP MATERIAL SEGMENTS

REFERENCE TO RELATED APPLICATIONS

The subject matter of this apolication is related to the subject matter of U.S. Pat. No. 4,401,044, entitled "System and Method for Manufacturing Seamed Articles", U.S. patent application Ser. No. 345,756, entitled "Automated Seamed Joining Apparatus", filed Feb. 4, 1983, U.S. patent application Ser. No. 515,126, entitled "Automated Assembly System for Seamed Articles", filed July 19, 1983, and PCT Application No. PCT/US84/00378, entitled "Assembly System For Seamed Articles", filed Mar. 8, 1984.

BACKGROUND OF THE INVENTION

The present invention is in the field of automated assembly of articles made from limp material, and more particularly to systems for folding limp material.

Conventional assembly line manufacture of seamed articles constructed of limp fabric consists of a series of manually controlled assembly operations. Generally tactile presentation and control of the fabric-to-be-joined is made to the joining, or sewing, head under manual control. One drawback of this application technique is that the technique is labor intensive; that is, a large portion of the cost for manufacture is spent on labor. To reduce cost, automated or computer-controlled manufacturing techniques have been proposed in the prior art.

An automated approach to fabric presentation and control is disclosed in U.S. patent application Ser. No. 345,756. As there disclosed, pairs of belt assemblies are positioned on both sides of a planar region adapted for passage at the fabric, referred to as the fabric locus. The respective belt assemblies are driven to selectively provide relative motion along a reference axis to layers of fabric lying in the fabric locus. A joining, or sewing, head is adapted for motion adjacent to the fabric locus along an axis perpendicular to the reference axis. The respective belts maintain control of the limp fabric in the region traversed by the sewing head, with the respective belts being selectively retracted, permitting passage therebetween of the sewing head as it advances along its axis of motion. With this approach, control of the limp fabric is permitted in the regions which are to be joined.

In the above-referenced application PCT/US84/00378, a folding system is disclosed in conjunction with a seam joining assembly. That folding system incorporates a three-degree-of-freedom robot arm operating in conjunction with an adjustable beam having a plurality of fabric grabbing devices, and a vacuum table. This configuration, as disclosed, is used to achieve a desired fold geometry for a limp material segment which may then subsequently be presented to a sewing head for seam joining operations. That system is particularly effective for establishing fold geometry with relatively small cloth assemblies.

In addition to relatively small cloth assemblies, for example, sleeves, it is becoming increasingly important in the clothing industry to provide automated folding of relatively large cloth assemblies, for example, pants or coats. With prior art techniques, large cloth assemblies typically require relatively large seam joining machine throat operation, requiring complex mechanisms. The use of prior art techniques have not addressed such problems in a manner to provide the optimal system for such large assemblies. In systems utilizing vacuum tables and a robot arm, relatively high degrees of beam accuracy and alignment are required together with relatively high air handling capability for appropriate vacuum levels. Moreover, field-of-view optics limitations place severe size constraints on systems incorporating vision or image feedback in automated assembly operations.

Accordingly, it is an object of the present invention to provide an improved system for folding material segments.

Another object is to provide an improved system for folding relatively large limp material segments with a high degree of precision.

Yet another object is to provide a system for folding limp material segments with relatively low energy utilization and low cost components.

Still another object is to provide a system for folding limp material segments which is readily adaptable for use with a modular in-line automated garment assembly system.

A further object is to provide an improved system for folding material segments in a manner providing a relatively small required range of motion for a seam joining apparatus.

A still further object is to provide a system for folding material segments including improved orientation and alignment detection for the segment relative to the desired fold geometry.

SUMMARY OF THE INVENTION

Briefly, the present invention is directed to a system for folding a limp material segment. The system includes a segment support having a substantially planar support surface for the segment. The segment support surface has linear dimensions equal to or greater than a predetermined length D. A selectively operable belt assembly includes a matrix of elongated, substantially parallel endless belts overlying the support surface. Each of the belts includes a lower planar surface opposite and substantially parallel to the support surface. The belts are selectively movable in the direction of elongation of the belts. Generally, the outer belt surfaces are adapted to frictionally engage adjacent material segments. The support surface is selectively rotatable with respect to the belt matrix about a reference axis perpendicular to the support surface.

A fold-locus-defining assembly includes a sheet member and an associated assembly for positioning that sheet member. The sheet member has a substantially rigid, straight leading edge. The positioning assembly is selectively operable to retractably position the leading edge, and portions of the sheet member adjacent to that edge, between the support surface and the lower surfaces of the belts in a plane parallel to the support surface. The leading edge of the sheet member is maintained substantially perpendicular to the direction of elongation of the belts. A segment sensor is adapted to generate position signals representative of the position of a segment on the support surface.

A belt matrix vertical position assembly is selectively operable to position the belt assembly with respect to the support surface in the direction of the reference axis. As a result, the lower surfaces of the endless belts may be controllably moved towards or away from the support surface.

A controller is responsive to the position signals and to applied signals representative of a desired fold-locus on the segment for controlling the belt assembly, the rotation of the support surface with respect to the belt assembly, the fold-locus-defining assembly, and the belt position assembly to effect a fold of the limp material segment about a linear fold axis, as desired.

In one form of the invention, in operation, with the material segment properly aligned on the support surface, the controller is sequentially operative to, first, position the belt assembly with respect to the support surface so that the lower surfaces of the belt are spaced apart from a segment on the support surface by a distance greater than the thickness of the material segment (which may be multiple layers of material) on the support table. The controller then rotates the support surface with respect to the belt assembly so that the desired fold axis is perpendicular to the direction of elongation of the belts. The sheet member position is controlled so that the sheet member overlies and is adjacent to the segment with its leading edge adjacent to the desired fold locus. Then, the belt assembly is positioned with respect to the support surface so that the lower surfaces of the belt are biased, or pressed, against the underlying sheet member which overlies a portion of the segment and against the upper surface of the remainder of the segment. The belts are then moved so that the portion of the lower surfaces of the belts biased against that remainder of the segment are controlled to move towards the leading edge, with the rest of the lower belt surfaces moving in the same direction. This motion is controlled at least until all of the remainder of the segment overlies the sheet member. In this stage of operation, the lower surfaces of the belts are frictionally engaged to the upper layer of limp material which extends beyong the sheet member, causing that upper layer portion to be folded back on top of the sheet member, establishing the desired fold. The sheet member is then retracted from between the support surface and the lower surfaces of the belts, leaving the folded segment between those surfaces.

In one form of the invention, during the above operations, the lowermost layer of the limp material is held to the lower surface, that is, the sliding coefficient of friction between the lower material layer and the support surface is maintained relatively high. In one form of the invention, this may be established by a coupler which includes a plurality of cylindrical shafts which are selectively extendable from the support surface. When the high coefficient of friction is desired, the shafts may be controlled to extend from the support surface and penetrate the limp material. When the coefficient of friction is desired to be relatively low, for example, if it is desired that the material be slid across the surface of the support member, the shafts may be retracted from the material to be at or below the level of the support surface.

In accordance with another feature of the present invention, the belt assembly may be selectively operated with another belt assembly, partially interleaved therewith, so that the interleaved belts effectively load or unload a material segment to or from the folding system. The folding system belt assembly may be selectively translated in a direction of elongation of the belts with the segment frictionally coupled to the belts and not to the underlying surface. This aspect of the invention permits movement of the limp material segment in that direction across the support surface until the two belt assemblies are interleaved. Then the segment continues under the control of the exterior belt assembly. To accomplish loading, prior to a folding operation, the belt assembly may be moved to one extreme position to meet an external belt assembly of a fabric transfer device of another portion of an overall article assembly system. The interleaved belts of the two belt assemblies may then effectively transfer the limp material segment from one of those belt assemblies to the other.

Once a material segment is so transferred to the folding system, the geometry and orientation of that segment may be determined. In one form at the invention, where the support surface is generally circular, that surface, with the segment thereon, may be rotated relative to a linear array of optical sensors extending generally parallel to the support surface. The sensors are effective to detect "light/dark" (that is, edge-denoting) transitions in an effective image formed by the limp material on the support surface against the background established by that surface. The detected edges are processed to generate signals representative of the metrical contour and orientation of that contour relative to a reference axis on the support surface. Alternative scanning techniques may also be used.

Following the desired folding operation, the translational motion of the belt assembly matrix may similarly be utilized to transport the folded segment to a complementary set of endless belts which may be used to withdraw the folded material from the folding system (without disturbing the fold relationships), for example, to be then presented to a seam joining apparatus.

With the present invention, a folding system is established which provides the ability to handled relatively large cloth areas (for example, 2,000 square inches) with a relatively long length of fold (for example, 90 inches). Such dimensions are particularly useful in the assembly of a pair of pants, for example. Moreover, the system is particularly effective to align and shift the seam-to-be-sewed relative to the sewing-station in order to minimize operations to be performed in the seam joining apparatus itself. Moreover, with the movable belt matrix, the system may transfer the folded segment from the folding system to a seam joining apparatus with no loss of alignment. All this may be attained with relatively highly efficient energy utilization and relatively low cost components, since there are no vacuum systems and robot systems and the like. The system is particularly adaptable to a modular operation within an on-line garment assembly system. An overall advantape is to be able to fold a limp material segment on a precise line relative to the geometry of the desired segment assembly.

BRIEF DESCRIPTION OF THE DRAWINGS

The foregoing and other objects of this invention, the various features thereof, as well as the invention itself, may be more fully understood from the following description, when read together with the accompanying drawings in which:

FIGS. 6A–6F illustrate the operation of the system of FIG. 1.

DESCRIPTION OF THE PREFERRED EMBODIMENT

Figure 1:
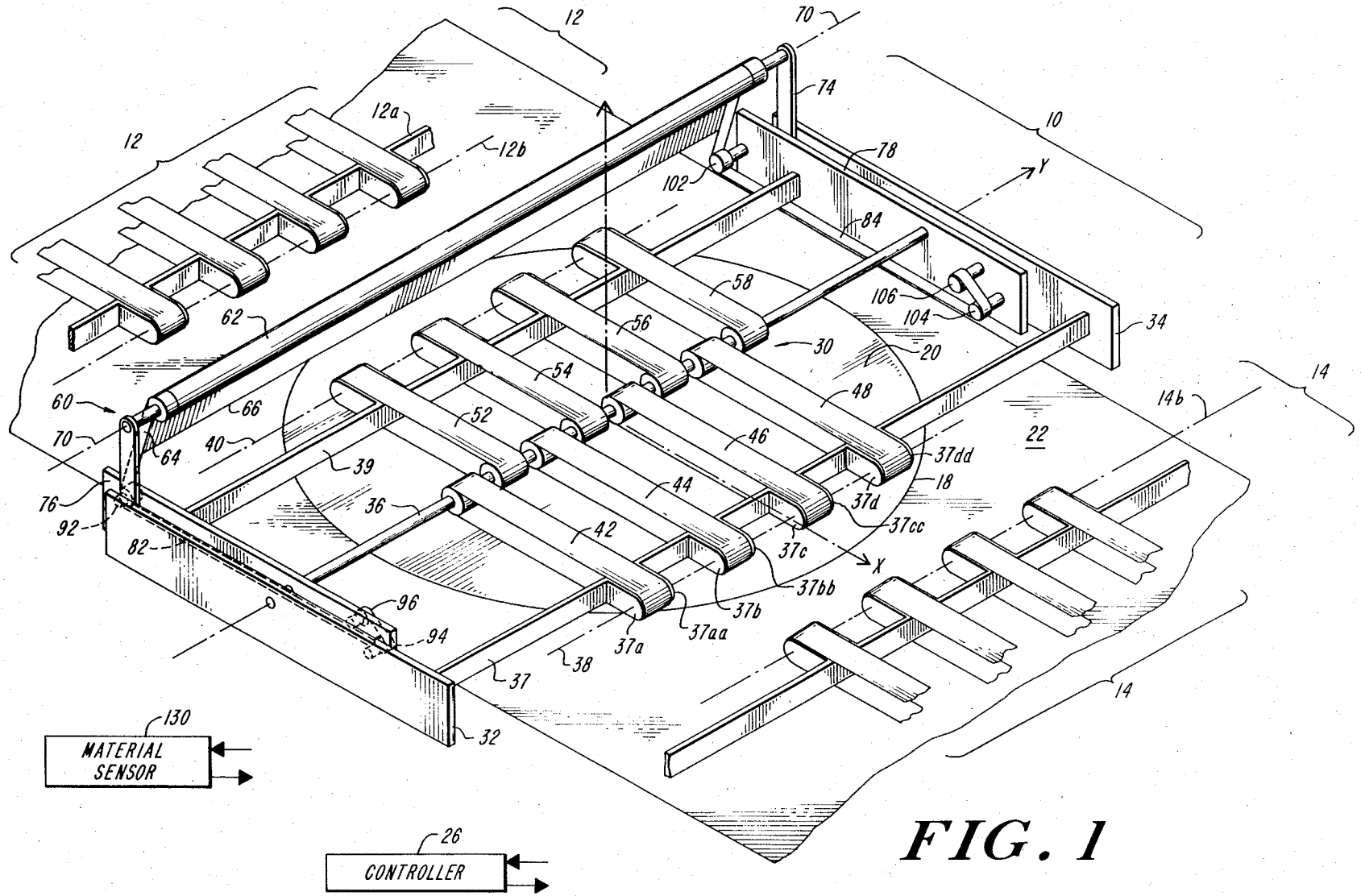
FIG. 1 shows, in schematic form, a perspective view of an exemplary fabric folding system in accordance with the present invention.
Figure 2:
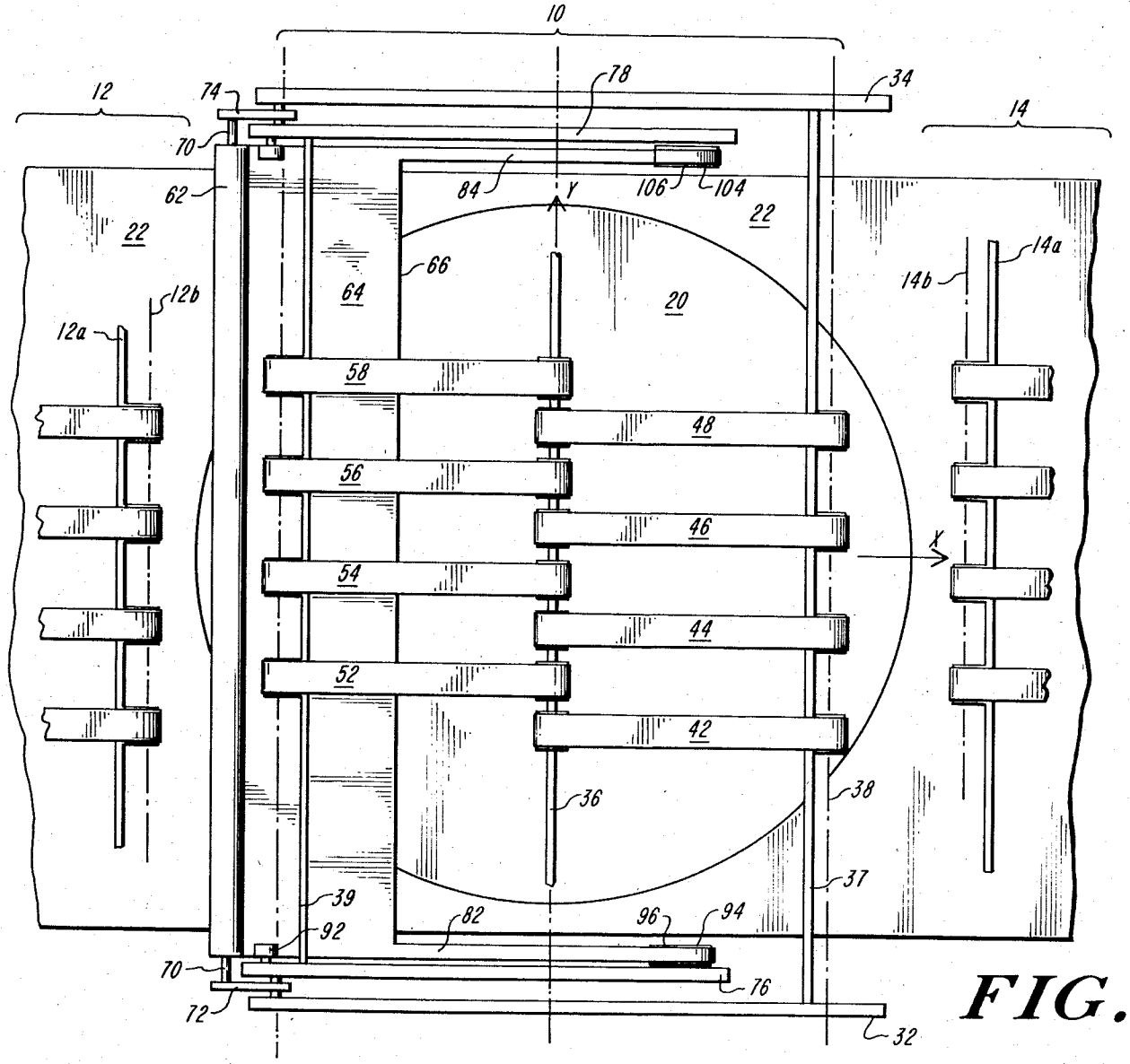
FIG. 2 shows a top plan view of the system of FIG. 1.
Figure 3:
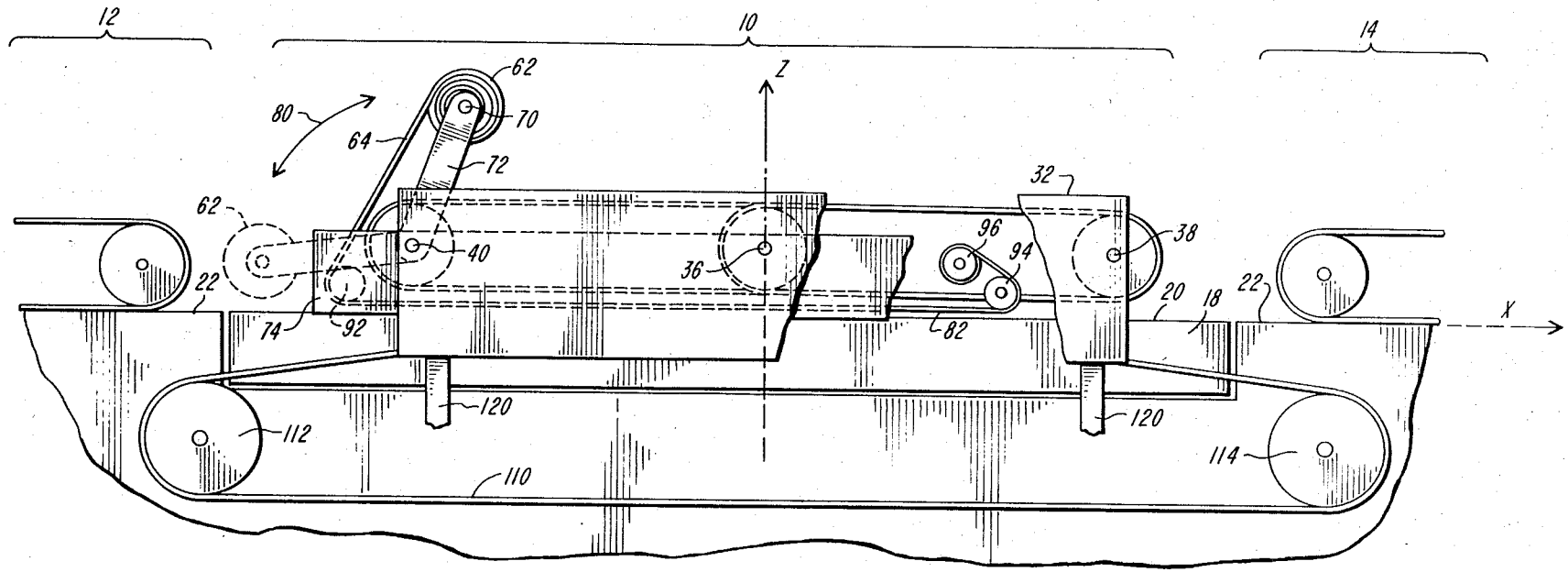
FIG. 3 shows a side elevation view of the system of FIG. 1.

FIGS. 1–3 show a portion of an exemplary system for assembling seamed articles, including a limp material folding system 10 embodying the present invention, and associated endless belt matrices 12 and 14 (and underlying support surfaces) for transporting a segment of limp material to and from the folding system 10. An X, Y, Z coordinate system is shown in FIG. 1 for reference purposes. The illustrated portions of belt matrices 12 and 14 show the "idler" ends (i.e., the non-driven ends) of the respective belts of those matrices. The idler ends of the belts of matrix 12 are supported by a support assembly member 12*a* (which includes X-directed idler roller supports extending therefrom) and which is adapted to permit rotation of the belts of matrix 12 about an axis 12*b* extending in the Y-direction. Similarly, the idler ends of the belts of matrix 14 are supported by a support assembly 14*a* (which includes X-directed idler roller supports extending therefrom) and which is adapted to permit rotation of the belts of matrix 14 about an axis 14*b* extending in the Y-direction.

By way of example, the system 12 may be a material transport station for transporting a segment of material from a seam joining station (not shown) adjacent to the left as shown, to the folding system 10, and belt system 14 may be adapted for transporting a limp material segment from the folding system 10 to another seam joining station (not shown) to the right, as shown of the matrix 14. The matrices 12 and 14 may include similar belt matrices opposite to those illustrated within the support surface underlying those matrices 12 and 14. The outer surfaces of the belts within matrices 12 and 14 are adapted to frictionally couple to limp material between the belts and the underlying support surface so that when the belts are moved, that material may be transported in accordance with the belt movement generally in the direction of the X axis as shown in FIG. 1.

The folding system 10 includes a circular support table 18 having a substantially planar upper surface 20. The table 18 is positioned within a support surface having a planar upper surface 22 which is co-planar with surface 20. The surfaces 20 and 22 are co-planar with the plane defined by the X and Y axes of reference coordinate system. The table 18 is adapted for selectively controlled rotational motion about the Z axis of the reference coordinate system, as described more fully below. In the present embodiment, which is adapted for folding a limp material segment having a maximum linear dimension, D, the support surface 20 has a diameter equal to D, although larger diameters could be used in other embodiments.

The folding system 10 also includes a selectively operable belt assembly 30. The belt assembly 30 includes two end members 32 and 34 which support rotatable shaft 36, support member 37 and support member 39. In the present embodiment, the shaft 36 is driven by an external driver under the control of a controller 26. The belt matrix 30, as shown, includes two sub-matrices of the elongated, substantially parallel endless belts. The first sub-matrix includes belts 42, 44, 46 and 48 and the second sub-matrix includes belts 52, 54, 56 and 58. The belts 42, 44, 46 and 48 are coupled to the shaft 36 support member 37, and the belts 52, 54, 56 and 58 are coupled to shaft 36 in an interleaved manner with belts 42, 44, 46 and 48. The belts 52, 54, 56 and 58 are further coupled to support member 39.

Support member 37 includes X-directed idler roller supports 37*a*, 37*aa*, 37*b*, 37*bb*, 37*c*, 37*cc*, 37*d* and 37*dd* for supporting idler rollers and permitting rotation of the respective belts 42, 44, 46 and 48 about an idler axis 38 extending in the Y-direction. Similarly, support member 39 includes X-directed idler roller supports 39*a*, 39*aa*, 39*b*, 39*bb*, 39*c*, 39*cc*, 39*d* and 39*dd* for supporting idler rollers permitting rotation of the respective belts 52, 54, 56 and 58 about idler axis 40 extending in the Y-direction. The X-direction offsets between axis 40 and support member 39 and between axis 12*b* and support 12*a* permit the belts of matrix 12 and belts 52, 54, 56 and 58 of matrix 30 to overlap in an interleaved fashion. Similarly the X-direction offsets between axis 38 and support number 37 and between axis 14*b* and support 14 permit the belts of matrix 14 and the belts 42, 44, 46 and 48 of matrix 30 to overlap in an interleaved fashion. With this configuration one matrix can readily transfer control of a material segment lying thereunder to the interleaved matrix.

Figure 3A:
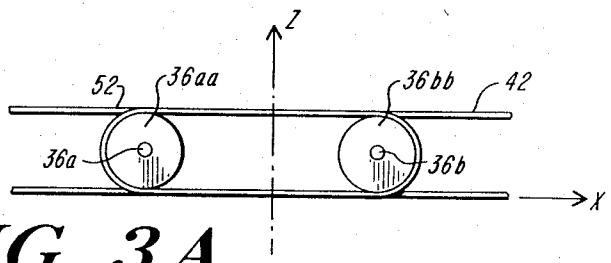
FIG. 3A shows an alternative drive configuration for the belt matrix of the system of FIGS. 1–3.
Figure 4:
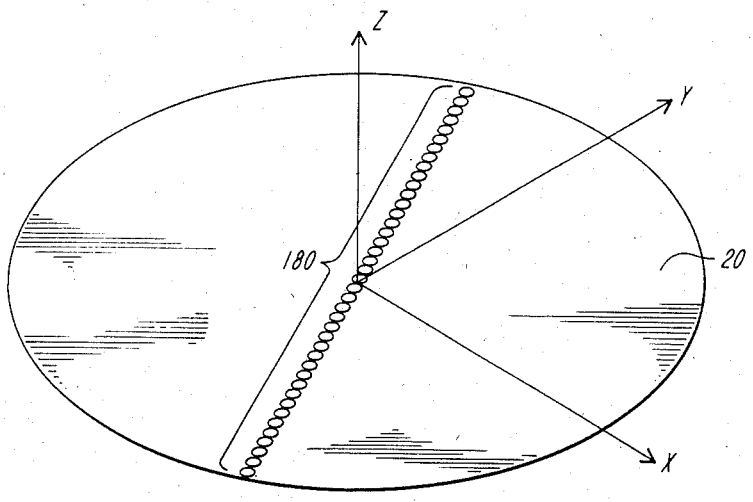
Figure 5A:
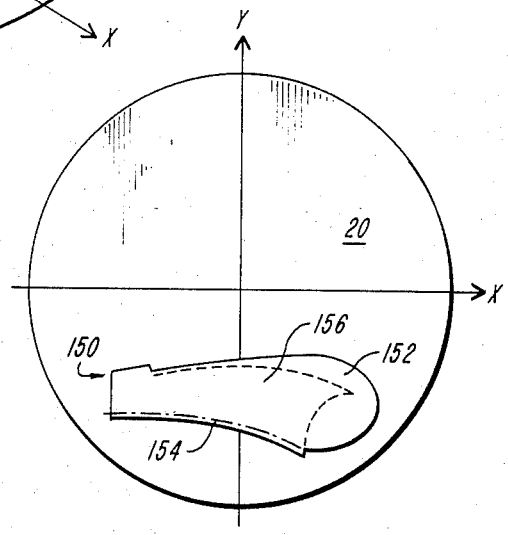
FIG. 5 shows a perspective view of a support surface for use with the system, incorporating a linear array of material sensors.
Figure 5B:
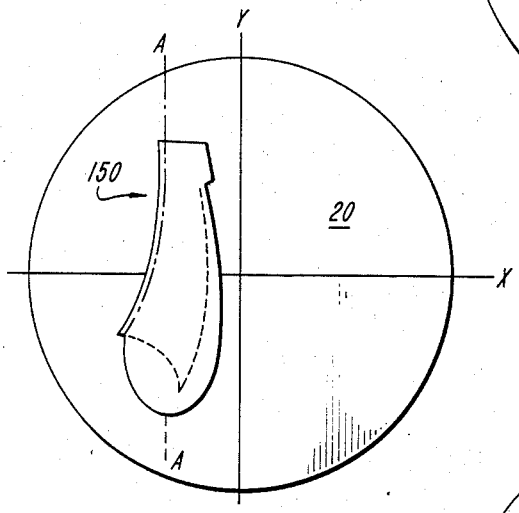
Figure 5C:
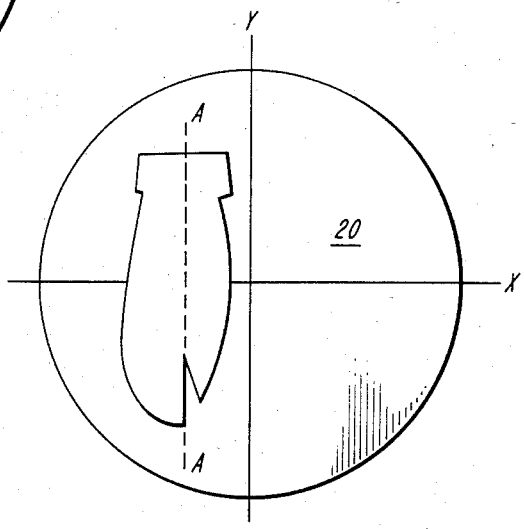
Figure 5D:
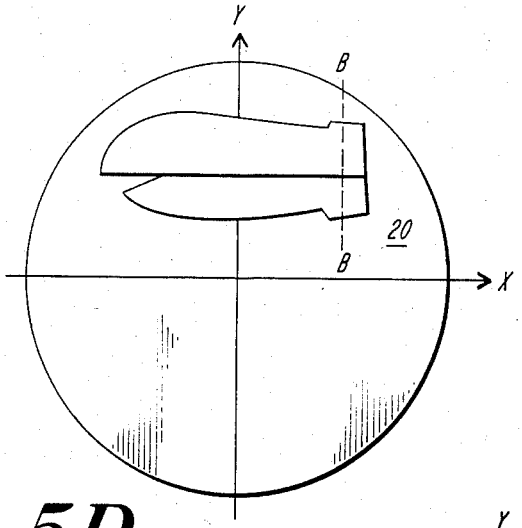
Figure 5E:
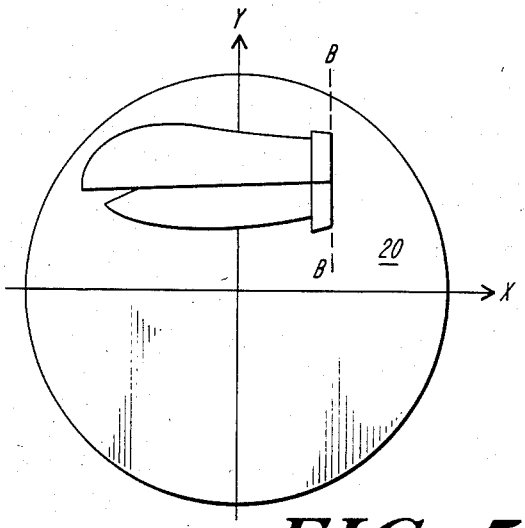
Figure 5F:
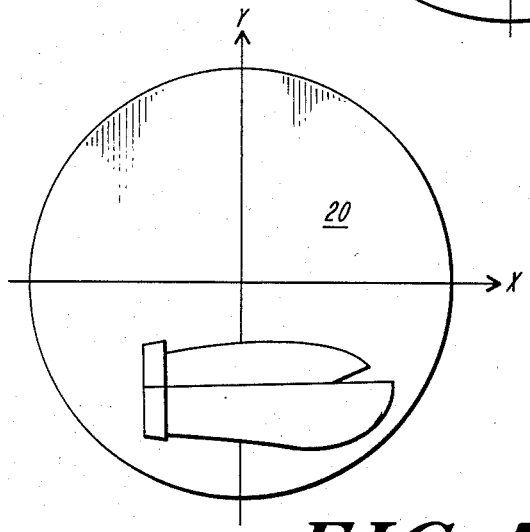

In the illustrated embodiment, only eight belts are shown in the matrix 30, although in other embodiments, differing numbers of belts and differing relative belt widths, lengths, and separations may be incorporated. The belts 52, 54, 56, 58 and 42, 44, 46, 48 are coupled to common drive shaft 36 so that a shaft drive motor (not shown) may selectively control the belts so that their lowermost surfaces move together in a direction parallel to the X-axis. In alternative configurations the belts 42, 44, 46 and 48 may be driven by a separate drive motor from the drive motor that drives the belts 52, 54, 56 and 58. FIG. 3A illustrates a portion of such a system, showing a drive configuration where a drive shaft 36*a* and associated drive roller 36*aa* is coupled to belts 42, 44, 46 and 48 and a drive shaft 36*b* and associated drive roller 36*bb* is coupled to belts 52, 54, 56 and 58. With this configurations, rollers 36*aa* and 36*bb* may be selectively and independently driven.

In the system of FIGS. 1–3, the lowermost surfaces of the belts of matrix 30 are substantially parallel and opposed to the support surface 20. As shown in FIGS. 1–3, the direction of elongation of the belts of matrix 30 is in the direction parallel to the X axis.

The folding system 10 further includes a fold-locus-defining assembly 60. In the embodiment of FIGS. 1–3, assembly 60 includes a canister 62, housing a retractable sheet member 64. The sheet member 64 has a straight leading edge 66 having a length L. The canister 62 is supported on a shaft 70 by pivot arms 72 and 74 which are pivotally connected to end plates 76 and 78, respectively. The pivot arms 72 and 74 are adapted for controlled pivotal motion between the two positions shown in FIG. 3, indicated by arrow 80. The flexible sheet member 64 includes two elongated portions 82 and 84 extending from the respective ends of the leading edge 66. The elongated portion 82 is adapted for passage around idler rollers 92 and 94 to take-up roller 96. Similarly, the elongated member 84 is adapted for passage around idler rollers 102 and 104 to take-up roller 106. The sheet member 64 in the present embodiment is spring-loaded to return to the canister 62. Alternatively, the return of member 64 to canister 62 may be motor controlled.

Selectively controlled drive motors (not shown) coupled to take-up rollers 96 and 106 are selectively operative under the control of controller 26 to take up, and withdraw, the elongated portions 82 and 84. In a first state, with the pivot members 72 and 74 in the vertical position, as shown in FIG. 1, the sheet member is fully retracted within canister 62 and the leading edge 66 is maximally spaced apart from the support surfaces 20 and 22. As described below, when the pivot members 72 and 74 are in the horizontal position, the take-up rollers 96 and 106 are operated to selectively withdraw the sheet member 64 from the canister 62 so that the leading edge 66 is positioned at a desired point along the surface 20, perpendicular to the X axis. Such operation is illustrated in FIG. 2. Rollers 92 and 94 and 102 and 104 ensure that the leading edge 66 and portions of sheet member 64 adjacent to that edge are maintained in a plane substantially parallel to surface 20 when withdrawn from the canister 62.

The belt assembly 30 in the folding system 10 is adapted for translational motion along the X axis. More particularly, as shown in FIG. 3, the end members 32 and 34 of the belt assembly 30 are coupled beneath the surface 20 to a translating belt 110 which passes about rollers 112 and 114. These rollers are selectively controlled by the controller 26 to cause the belt assemblies coupled to members 32 and 34 to be translated along the X axis.

In addition, the folding system 10 includes vertical positioning assemblies indicated by reference designations 120 and 122 in FIG. 3. These assemblies are selectively operative from controller 26 to raise and lower the members 32 and 34, and the belts supported by those members.

The folding system 110 further includes a material sensor 130 which provides position signals representative of the position of a material segment on the support surface 20. In the preferred embodiment, the material sensor incorporates an array of optical sensors beneath the support surface 20 adapted for determining when a material segment overlies those sensors.

FIG. 5 shows the support surface 20 including an exemplary linear array of photodetectors 180 for use with the system 10 as described. Each detector in array 180 operates in conjunction with an illumination source directed toward surface 20 to generate a signal representative at the presence or absence, as the case may be, of relatively opaque material overlying that detector. The various detectors are coupled to the controller 26. As shown in FIG. 5, the array 180 extends fully along a diameter of surface 20. In other embodiments, the different arrays may be used, for example, the detectors in the array might extend linearly from the Z axis to a point near or at the perimeter of surface 20. Moreover, as shown, the detectors of array 180 are imbedded in surface 20, and thus is affixed to that surface.

In operation of the present embodiment, the position of a material segment on surface 20 between belt assembly 30 and surface 20 may be determined with respect to the X and Y axes in the following manner. Initially, the surface 20 is maintained so that there is a relatively low coefficient of friction between that segment and surface 20 (e.g., by maintaining the steel wires in surface 20 fully retracted). The belt assembly 30 is biased toward surface 20, maintaining the segment in a fixed position relative to the X and Y axes. Then, the surface 20 is rotated about the Z axis. As surface 20 (and array 180) rotates, controller 26 monitors the signals generated by the detectors in array 180, detecting light-dark transitions denoting the contour of the segment. Alternatively, with the array 180 angularly offset with respect to the X-axis, the belt matrix 30 may control the segment to pass fully across the array 180, while controller 26 monitors the light-dark transitions. The detected light-dark transitions are indicative of the position of the material relative to the X and Y axes. Thus, a further vision, or imaging, system, wide angle or otherwise, is not necessary.

In the present embodiment, the controller 26 accounts for light-dark transitions for light-dark transitions due to the belts of matrix 30. Alternatively, a two-pass operation might be used where matrix 30 is positioned in the Y-direction as shown in FIGS. 1 and 2 during the first pass, and then matrix 30 is shifted in the Y-direction by a distance equal to the belt-to-belt seperation during the second pass.

Other arrangements may be used whereby the array seams the surface so that signals may be generated representative of the contour of a segment on surface 20.

The controller 26 in the preferred form of the invention, is a general purpose computer programmed to control operation of the belt assembly 30, the drive assembly, the rotation of the surface 20, the fold-locus-defining assembly 60, and the belt positioner (as implemented by elements 120 and 122) to fold a material segment about a linear fold axis in response to the position signal and applied signal representative of a desired fold locus on a material segment. More particularly, the belt 110 may be selectively controlled to transport the belt assembly 30 to be adjacent to the belt assembly 12 to provide interweaving of the moving belts of the respective assemblies so that a material segment may be extracted from beneath the belts 12 and inserted between the belts of assembly 30 and the support surface 20. The belts of assembly 30 may be then controlled to transport the received material segment to a desired location on surface 20. This location may be determined by the material sensor 130 so that an exact representation of the material segment may be generated relative to coordinate references of the folding system 10.

Thereafter, the belt assembly 30 may be raised vertically by means of lifting assemblies 120 and 122 so that the belts of assembly 30 are spaced apart maximally from the support surface 20. The controller 26 then rotates the support surface 20 so that a desired linear fold locus is aligned perpendicular to the X axis. At that point, the arms 72 and 74 are pivoted to their horizontal position (by motors not shown), and the drivers for the take-up rollers 96 and 106 are activated to withdraw the sheet member 64 from the canister 62. The rollers 96 and 106 are activated until leading edge 66 is immediately overlying the desired fold locus on the material on-surface 20. In the preferred embodiment, the sheet member 64 is made of a flexible sheet of steel, for example 0.005 inch thick. Following the lowering of belt assembly 30, an associated magetic field generator is activated to pull the extended sheet member 64 and bias, or press, that sheet member 64 against the material on surface 20. This "magnetic hold-down" of the sheet member 64 ensures good registration and stability of the material to the desired folding edge during the folding operation.

The elements 120 and 122 are then activated to lower the belts of assembly 30 and bias those belts against the extended portion of the sheet member and against the portion of the material extending beyond the leading edge 66 of the sheet member 64. Thereafter, the belts are activated so that their lowermost surfaces are moving in the X direction (with the portion to the right, as shown, of the leading edge 66 translating toward that leading edge and the portion to the left of the leading edge moving in that same direction. With the belts being in frictional contact with the material, the portion of the material extending to the right of the leading edge 66 of sheet member 64 is folded over on top of the sheet member 64 along the fold locus defined by the leading edge 66 of sheet member 64.

In one form of the invention, the folding system 10 further includes a selectively operable high friction system associated with the surface 20. By way of example, the high friction system may include a plurality of cylindrical members (or wires) which may be selectively extended from the surface 20 to penetrate material lying on that surface. When so extended, those elements provide a relatively high friction force between the lowermost layer of material on surface 20 and surface 20. As a result, during the folding operation, as an upper layer may be folded across the sheet member 64 while ensuring that there be no motion of the lower layer of material relative to the surface 20.

Following the folding of the upper layer of the material segment, the belts in belt assembly 30 are stopped, and the magnetic hold-down for sheet member 64 is turned off. The member 64 is then retracted back into the canister 62 and the pivot arms 72 and 74 are shifted to their vertical position (as shown in FIG. 1). The folded material segment is now ready for a further folding operation between the belts of assembly 30 and surface 20 or for transfer to the belts 14 (with the translation of the belt assembly 30 by means of belt 110) for transfer to another station in the article assembly system. Prior to such transfer, the high friction elements in the surface 20 are retracted so that the folded material segment may be freely transferred across surface 20 in an undisturbed folded condition with a desired attitude.

Figure 4A:
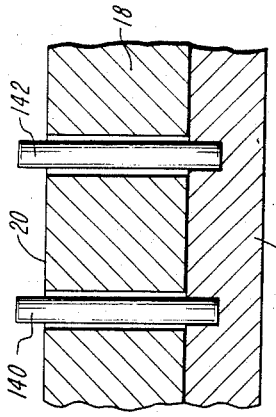
FIGS. 4A and 4B show a sectional view of a portion of the support table of the system of FIG. 1.
Figure 4B:
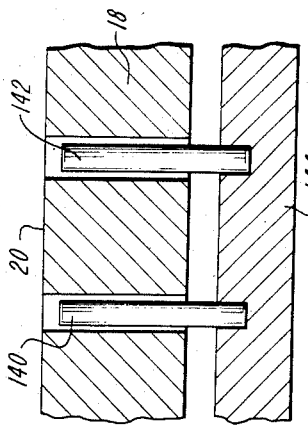

FIGS. 4A and 4B show a portion of an exemplary high friction system for generating a relatively high coefficient of friction for a portion of a material segment on the surface 20. The system of FIG. 4A shows the table 18 with two cylindrical shafts surrounding two steel wires 140 and 142 supported in those shafts by an underlying support member 144. The support member 144 is held adjacent to table 18 (for example, by electromagnetic means), thereby forcing the wires 140 and 142 to extend from surface 20. FIG. 4B shows the same portion of the table 18 and elements 140, 142 and 144, but wherein the support member 144 is lowered with respect to the table 18. As a consequence of this lowering (for example by gravity), the steel wires 140 and 142 are retracted below the level of surface 20 of table 18. When the wires are extended as in FIG. 4A, the wires are adapted to penetrate material and overlying material segments supported on the surface 20. When the wires are retracted as shown in FIG. 4B, the material segment is freely transferrable over the surface 20.

FIGS. 6A–6F illustrate the operation, in part, of the system 10. FIG. 6A shows support surface 20 (with respect to reference axes X and Y) supporting a folded, partially assembled sleeve 150. Sleeve 150 includes an upper layer 152 joined along a seam 154 to an underlying lower layer 156. Sleeve 150 is positioned on surface 20 so that sleeve has been transferred along the X axis from a sewing station by belt assembly 12 with the belt assembly 30 lowered and the wires in surface 20 retracted.

Surface 20 is then rotated ninety degrees clockwise with the belt and assembly 30 raised and the wires in surface 20 retracted, and the belt assembly 30 is lowered, with the wires still retracted, and operated to translate the sleeve assembly to the position shown in FIG. 6B.

Then the belt assembly 30 is raised and sheet member 6A is withdrawn from canister 62 os that its leading edge 66 lies along axis A—A (shown in FIG. 6B). The belt assembly 30 is then lowered and the wires in surface 20 are raised. Belt assembly 30 is then operated to fold back the portion of upper layer 156 from the right (as shown) of axis AA to the left of that axis so that sleeve 150 appears as shown in FIG. 6C. Sheet member 64 is then retracted to canister 62. The belt assembly 30 is then raised and the wires of surface 20 retracted, and the surface 20 is rotated ninety degrees clockwise to the position shown in FIG. 6D. The sheet member 64 is again withdrawn from canister 62 until its leading edge 66 overlies axis B—B in FIG. 6D. The belt assembly 30 is lowered and then the belts are operated to fold back the portion of sleeve 150 to the right (as shown) of axis B—B to the left of that axis so that sleeve 150 appears as shown in FIG. 6E. Member 64 is then retracted back to canister 62.

Finally, with the belt assembly 30 raised and the wires in surface 20 retracted, the surface 20 is rotated 180 degrees so that the sleeve 150 is oriented as shown in FIG. 6F, where it may then be transferred by belt assembly 30 and belt assembly 14 to another sewing station. The latter 180 degree rotation moves the sleeve 150 to the half plane below the X axis, so that any subsequent sewing at a sewing station only requires a limited range of motion of the sewing head, rather than requiring a range of motion equal to the full diameter of the surface 20. Accordingly, this selective orientation step may be effective in permitting more efficient operation of the overall article assembly system.

The preferred embodiment and its operation have been described above as incorporating a single fold-locus-defining assembly 60, where the leading edge 66 extends from and returns to the canister 62 on the left side (as illustrated, in FIG. 1) of matrix 30. In alternative embodiments, a second similar fold-locus-defining assembly may be positioned on the right side of matrix 30, so that its leading edge extends from and returns to a canister to the right of the matrix 30. In the latter form, either of the leading edges may be selectively used, as is convenient and permitting automated folding where the reorientation and transporting of the material segment is minimized, thereby minimizing the danger of a folded portion unfolding.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A system for folding a limp material segment, said segment having a maximum linear dimension D, comprising A. means for supporting said segment including a substantially planar support surface for said segment, said support surface having linear dimensions equal to or greater than D, B. selectively operable belt assembly including a matrix of elongated, substantially parallel endless belts overlying said support surface, each of said belts including a lower planar surface opposite and substantially parallel to said support surface, said belts being selectively movable in the direction of elongation of said belts, C. selectively operable means for rotating said support surface with respect to said belt matrix about a reference axis perpendicular to said support surface, D. a fold-locus-defining assembly including a sheet member and associated sheet means for positioning said sheet member, said sheet member having a substantially rigid, straight leading edge, and said positioning means including selectively operable means for retractably positioning said leading edge and adjacent portions of said sheet member between said support surface and said lower surfaces of said belts and in a plane parallel to said support surface, whereby said leading edge is substantially perpendicular to the direction of elongation of said belts, E. sensing means for generating position signals representative of the position of a segment on said support surface, F. selectively operable belt positioning means for positioning said belt assembly with respect to said support surface in the direction of said reference axis, G. controller including means responsive to said position signals and to applied signals representative of a desired fold locus on said segment for controlling said belt assembly, said rotating means, said fold-locus-defining assembly and said belt positioning means to fold said material segment about a linear fold locus.

2. A system according to claim 1 wherein said controller is sequentially operative to:

i. position said belt assembly with respect to said support surface whereby said lower surfaces of said belts are spaced apart from a segment on said support surface, ii. rotate said support surface with respect to said belt assembly whereby said fold axis is perpendicular to the direction of elongation of said belts, iii. position said sheet member whereby said sheet member overlies and is adjacent to said segment, and said leading edge is adjacent to said fold locus, iv. position said belt assembly with respect to said supoort surface whereby said lower surfaces of said belts are biased against said underlying sheet member which overlies a portion of said segment and against the upper surface of the remainder of said segment, v. move said belts whereby the portion of said lower surfaces of said belts biased against said remainder of said segment move toward said leading edge, and the rest of said lower surfaces move in the same direction, until all of said remainder of said segment overlies said sheet member, vi. position said sheet member whereby said sheet member is wholly retracted from between said support surface and said lower surfaces of said belts.

3. A system according to claim 1 or 2 wherein said support means further includes a selectively operative means for coupling a segment to said support surface with a high coefficient of friction.

4. A system according to claim 3 wherein said coupling means comprises a plurality of cylindrical shafts selectively extendible from said support surface, and associated means for selectively extending said shafts beyond said surface and retracting said shafts at or below said surface.

5. A system according to claim 1 or 2 further comprising means for selectively translating said belt assembly in the direction of elongation of said belts.

6. A system according to said claim 1 or 2 wherein said matrix of belts includes, two interleaved sub-matrices, each of said sub-matrices being coupled to a common drive shaft and roller assembly and having a separate associated idler shaft and roller assembly, said idler shaft and roller assemblies for the respective sub-matrices being on opposite sides of said drive shaft and roller assembly.

7. A system according to claim 6 further comprising means for selectively translating said belt assembly in the direction of elongation of said belts.

8. A system according to claim 1 or 2 wherein said sheet member and associated positioning means includes a sheet member rolled at least in part onto a shaft member, with said leading edge outermost, means for biasing said rolled sheet member to a fully rolled position, selectively operative means for pulling said leading edge whereby said rolled sheet member unrolls at least in part, and means for controlling the position of said leading edge and adjacent unrolled portions of said sheet member to be between said support surface and said lower surfaces of said belts in a plane parallel to said support surface.

9. A system according to claim 1 or 2 wherein said sensing means includes an array of photo detector devices and associated means for scanning said array across said support surface, and includes means responsive to said photo detector devices for generating signals representative of contour points of a limp material segment on said support surface.

10. A system according to claim 9 wherein said array is a linear array extending between the said reference axis perpendicular to support surface and a perimeter point of said support surface.

11. A system according to claim 10 wherein said array is affixed to said support surface.

12. A system according to claim 9 wherein said array is affixed to said support surface.

* * * * *